US007946899B2

(12) United States Patent
Moench et al.

(10) Patent No.: US 7,946,899 B2
(45) Date of Patent: May 24, 2011

(54) HIGH-PRESSURE MERCURY VAPOR DISCHARGE LAMP AND METHOD OF MANUFACTURING A HIGH-PRESSURE MERCURY VAPOR DISCHARGE LAMP

(75) Inventors: Holger Moench, Vaals (DE); Pavel Pekarski, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 293 days.

(21) Appl. No.: 12/159,466

(22) PCT Filed: Dec. 21, 2006

(86) PCT No.: PCT/IB2006/054994

§ 371 (c)(1),
(2), (4) Date: Jun. 27, 2008

(87) PCT Pub. No.: WO2007/077506

PCT Pub. Date: Jul. 12, 2007

(65) Prior Publication Data

US 2009/0016064 A1 Jan. 15, 2009

(30) Foreign Application Priority Data

Jan. 3, 2006 (EP) ..... 06100044

(51) Int. Cl.
*H01K 1/30* (2006.01)
*H01J 5/48* (2006.01)

(52) U.S. Cl. ..... 445/26; 313/623; 313/627; 445/27; 445/28

(58) Field of Classification Search ..... 313/627–643
See application file for complete search history.

(56) References Cited

U.S. PATENT DOCUMENTS

| | | | | |
|---|---|---|---|---|
| 4,389,201 | A | 6/1983 | Hansler et al. | |
| 5,109,181 | A * | 4/1992 | Fischer et al. | 313/571 |
| 2003/0042856 | A1 * | 3/2003 | Kaneko et al. | 313/639 |
| 2004/0207306 | A1 * | 10/2004 | Horiuchi et al. | 313/113 |

FOREIGN PATENT DOCUMENTS

| | | | |
|---|---|---|---|
| DE | 3813421 | A1 | 11/1989 |
| DE | 10065423 | A1 | 7/2001 |
| EP | 0338637 | A2 | 10/1989 |
| EP | 0903771 | A2 | 3/1999 |
| EP | 1289001 | A2 | 3/2003 |
| EP | 1294012 | A2 | 3/2003 |
| WO | 9535645 | A1 | 12/1995 |
| WO | 0036882 | A1 | 6/2000 |
| WO | 0036883 | A1 | 6/2000 |

* cited by examiner

*Primary Examiner* — Nimeshkumar D Patel
*Assistant Examiner* — Tracie Green

(57) ABSTRACT

A high-pressure mercury vapor discharge lamp (1) comprising an envelope (2) of high temperature resistant material having a discharge vessel (3) and two electrodes (5, 6) extending from two seal portions (4) into the discharge vessel (3), the two electrodes having an electrode gap (de) smaller than or equal to 2.5 mm, preferably smaller than or equal to 1.5 mm, is described. The discharge vessel (3) contains a filling which essentially comprises the following substances: rare gas, oxygen, halogen consisting of chlorine, bromine, iodine, or a mixture thereof, as well as mercury in a quantity greater than or equal to 0.15 mg/mm3' The seal portions (4) have a cross-sectional area of between 6 mm2 and 20 mm2, preferably approximately 10 mm2. A method of manufacturing such a high-pressure mercury vapor discharge lamp (1) and a projector system for such a high-pressure mercury vapor discharge lamp (1) are also described.

4 Claims, 5 Drawing Sheets

Figure 1:
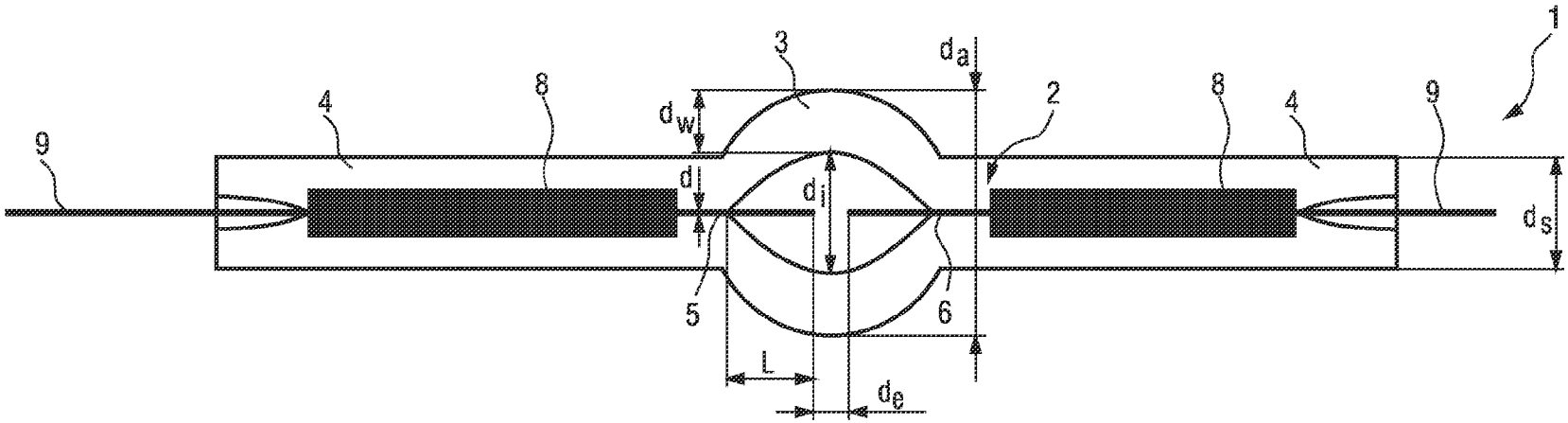

HIGH-PRESSURE MERCURY VAPOR DISCHARGE LAMP AND METHOD OF MANUFACTURING A HIGH-PRESSURE MERCURY VAPOR DISCHARGE LAMP

The invention relates to a high-pressure mercury vapor discharge lamp comprising an envelope of high temperature resistant material with a discharge vessel and two electrodes extending from two seal portions into the discharge vessel and having an electrode gap smaller than or equal to 2.5 mm, preferably smaller than or equal to 1.5 mm. The discharge vessel contains a filling which essentially comprises rare gas, oxygen, halogen, and mercury. The halogen is chlorine, bromine, iodine, or a mixture thereof. Mercury is present in a quantity of more than 0.15 mg/mm$^3$. Furthermore, the invention relates to a method of manufacturing such a high-pressure mercury vapor discharge lamp.

An arc is ignited for generating light between the two electrodes of the high-pressure mercury vapor discharge lamps. Because of the small electrode gap, these lamps are called short-arc lamps. During operation the mercury evaporates and, given a quantity of 0.15 mg/mm$^3$, usually provides a mercury vapor pressure of approximately 150 bar in the lamp. An example of a high-pressure mercury vapor discharge lamp of such a type—but with a still higher mercury portion—is described in DE 381 34 21 A1. Such lamps having mercury vapor pressures above 100 bar generate a high luminance and a relatively continuous spectrum. Therefore, these high-pressure mercury vapor discharge lamps are often denoted UHP lamps, wherein UHP means "Ultra High Pressure" because of the high pressure or "Ultra High Performance" because of the high luminance. A major field of application of these lamps is their use in projection systems. However, the high electrode load of the lamps leads to the fact that the tungsten evaporates from the electrodes and is deposited on the wall of the discharge vessel. This leads to a blackening of the envelope, as a result of which the latter heats up strongly, which in its turn may lead to an explosion of the envelope, particularly with high mercury vapor pressures. With the aforementioned lamps, this is further compounded by the relatively small dimensions of the envelope or the discharge vessel. Therefore, such a wall blackening must be categorically avoided. As a countermeasure against blackening of the wall owing to tungsten transport, the high-pressure mercury discharge lamp comprises, as mentioned, a small amount of at least one of the halogens chlorine, bromine, and iodine. These halogens cause a tungsten transport cycle with which the tungsten separated from the wall of the discharge vessel is transported back to the electrodes.

A constant problem with such a high-pressure mercury discharge lamp is that the lamps become extremely hot during operation. In order to prevent a destruction of the lamp, it should therefore be ensured that the lamp does not overheat. As is generally known, it should be particularly provided that the lamp does not get hotter than 350° C. to 400° C. at the outer ends of the seal portions, where the metal parts of the lamp, i.e. the supply lines to the electrodes, come into contact with the ambient air, in order to avoid a rapid oxidation of these parts, which usually comprise molybdenum. Furthermore, it is known that the temperature decreases in the longitudinal direction of the seal portions away from the main heat source, i.e. away from the hot discharge vessel in the center of the lamp envelope. For this purpose, the heat conduction devices and the temperature conditions in the lamp are described briefly below:

The main heating mechanism acting on the ends of the seal portions is the heat conduction through the material of the seal portions outwards from the center of the lamp. In addition, the molybdenum foil contributes to the thermal conduction by approximately 10 to 20%.

It is true that the seal portions are cooled by the radiation of the hot material, for example a quartz glass envelope of the hot quartz material, as well as by heat conduction against the ambient air. According to the Stefan-Boltzmann law, both mechanisms provide the best cooling when as large as possible a temperature difference with air is present.

However, the seal portions are burdened moreover by additional heat, which is back-reflected by radiation within a reflector or by the optical system. Here, there are three main mechanisms:

In the case of a metal reflector, heat radiation is reflected by the hot discharge vessel against the seal portions. This is boosted by the fact that the reflector is designed for a point source, whereas the hot discharge vessel has a larger dimension and hence radiation is imaged not only in the desired focus. As this radiation originates from the hot material of the discharge vessel, it is re-absorbed correspondingly well by the seal portions. Even in the case of dichroic reflectors (similar to a vaporized cold-light mirror), by which only visible light is reflected and IR and UV radiation is transmitted as much as possible, radiation from the discharge arc strikes the ends of the seal portion of the lamp. This radiation originates from the rear portion of the reflector. Since the discharge arc is also an expanded radiation source, the ray is not accurately focused, but part of it also strikes the ends of the lamp. This radiation is not absorbed by the envelope material, as it was already transmitted by the same material in the region of the discharge vessel, but it is absorbed by the metal parts in the seal portions.

The entire situation becomes yet more critical when optical systems customary in projection systems are used, where unwanted infrared and UV radiation and, in some cases, even unwanted colors are reflected back into the lamp. A substantial portion of this radiation also strikes the seal portions, since it comes from a region which is close to the second focal point of an elliptical reflector.

Therefore, the length of the seal portions and consequently the total length of the envelopes of the UHP lamps have usually been determined until now by the operating temperature that can be achieved in these locations. Hence, tight boundaries are set for a further miniaturization of the lamp envelopes and consequently also for a reduction in size of the optical systems into which the lamps are to be inserted.

It is an object of the present invention to provide a high-pressure mercury vapor discharge lamp of the type mentioned in the preamble having smaller dimensions and a corresponding method of manufacturing such a high-pressure mercury vapor discharge lamp with which the permitted temperatures at the ends of the seal portions are nevertheless not exceeded.

The object is achieved by a high-pressure mercury vapor discharge lamp according to claim 1 and by a method according to claim 8.

As was described above, a high-pressure mercury vapor discharge lamp according to the invention has an envelope of high-temperature resistant material, preferably quartz glass, or alternatively aluminum oxide. This envelope has a discharge vessel and two electrodes, preferably made of tungsten, extending from two seal portions at opposite sides into the discharge vessel. Here, the electrode gap is smaller than 2.5 mm, preferably smaller than 1.5 mm. The discharge vessel comprises, again as described above, a filling which in fact comprises the substances rare gas, oxygen, and a halogen consisting of chlorine, bromine, iodine, or a mixture thereof, as well as mercury in a quantity of more than 0.15 mg/mm$^3$.

The high-pressure mercury vapor discharge lamp according to the invention is structured such that the seal portions of the lamp envelope have a cross-sectional surface area of no more than between 6 $mm^2$ and 20 $mm^2$, particularly preferably of approximately 10 $mm^2$. This allows a significant shortening of the seal portions of the lamp while the permissible temperature levels at the ends of the seal portions are maintained.

Experiments with extensive computations, simulations and trials have shown that apart from the main heating mechanism specified above, there is a second substantial heating mechanism by which energy is transported from the discharge vessel to the ends of the seal portions. A portion of the radiation generated in the lamp does not leave the lamp envelope, but is guided within the seal portions by Total Internal Reflection (TIR) as in an optical waveguide. This radiation is then absorbed by the metal parts within the seal portions and contributes substantially to the heating of the ends of the seal portions.

Thanks to the advantageous arrangement of the envelope such that the cross-sectional area lies below 20 $mm^2$, this portion of the heat conduction can be greatly reduced—in contrast to known UHP lamps, which have a cross-section of at least one 25 $mm^2$ or as a rule well above it. This renders it possible to design the seal portions to be significantly smaller. Nevertheless, the temperatures in the end regions of the seal portions, where the metal comes into contact with air, remain below the desired 350 to 400° C. This renders it possible to design smaller lamps and consequently correspondingly smaller reflectors, as a result of which the optical structure in a projection system needs less space in total. Not only the total size of the projectors, but advantageously also the cost thereof can thus be considerably reduced.

A method according to the invention for manufacturing such a high-pressure mercury vapor discharge lamp comprises the following steps:

First, an envelope is manufactured from a tube of high temperature resistant material, preferably quartz glass, which envelope has a discharge vessel and two residual tube sections at opposite sides of the discharge vessel. Electrodes are then inserted into the two tube sections, which electrodes are connected via respective metal strip sections, made of molybdenum as a rule, to a supply line. Here, the electrodes are positioned such that they extend into the discharge vessel, and a precisely defined electrode gap of ≦2.5 mm; preferably ≦1.5 mm, is achieved. In addition, the discharge vessel with the filling described above is filled and sealed by pressing or fusing the tube sections into seal portions, in which the metal strip sections are tightly embedded.

The shaping of the tube into a discharge vessel, the insertion of the electrodes into the discharge vessel and the filling, and the sealing of the discharge vessel can be carried out in the customary way. A wide variety of methods is known to those skilled in the art for this purpose. Thus, for example, first one electrode may be inserted and then pressed or fused into a seal portion on this side of the tube section. The halides and the mercury are then introduced, the second electrode is inserted at the appropriate distance to the first electrode, and the second tube section is finally sealed after filling with the rare gases has taken place. In the final analysis, however, the sequence of when which electrode is inserted, when the filling is provided, and when the discharge vessel is sealed on which side, is not significant for the present invention. It is only substantial that the discharge vessel is formed such and the tube sections at the discharge vessel are pressed or fused into the seal portions such that the seal portions have a cross-sectional area of between and 6 $mm^2$ and 20 mm2, preferably of approximately 10 $mm^2$.

The dependent claims comprise particularly advantageous embodiments and further embodiments of the invention. In particular, the method of manufacturing the high-pressure mercury vapor discharge lamp may also be designed analogous to the dependent claims on the high-pressure mercury vapor discharge lamp, and conversely the high-pressure mercury vapor discharge lamp may also be embodied further in accordance with the dependent claims on the manufacturing process. Despite the relatively small cross-sectional area of the seal portions, in it is advantageously ensured that the wall thickness of the discharge vessel at the thickest point of the discharge vessel, denoted the equator of the lamp, is greater than or equal to 1.3 mm, preferably greater than or equal to 1.6 mm, and particularly preferably greater than or equal to 1.7 mm.

In a particularly preferred example of embodiment, the outer diameter of the discharge vessel at the thickest place is approximately 7.1 mm and the inner diameter at this place is approximately 3.5 mm.

Here, preferably, the lamp envelope can be formed of a tube with an outer diameter of only approximately 4.1 mm and an inner diameter of approximately 2 mm. Until now, such lamps were customarily formed from significantly thicker tubes. The tube sections of the discharge vessel may be shaped into the seal portions through pressing or fusing, as described above. Fusing is the preferred method here, as a greater compression strength can be achieved thereby. Seal portions are thus produced which have an essentially round diameter. Preferably, it is then ensured that the diameter of the seal portions is between 2.5 mm and 5 mm—preferably approximately 3.6 mm—in order to achieve the desired cross-sectional surface area.

In order to achieve the necessary wall thickness in the central region of the discharge vessel and at the same time a correspondingly small cross-sectional area in the region of the seal portions, the tube for forming the discharge vessel in the thickest place of the discharge vessel is compressed in axial direction by more than 250%, preferably by more than 300%, with simultaneous radial expansion. A method of implementing such a compression will be described hereinafter.

To keep the seal portions as short as possible, the length of the metal strip sections, which must be completely embedded in the seal portions, is preferably ≦12 mm.

Particularly preferably, electrodes are inserted into the high-pressure mercury vapor discharge lamp which are rod-shaped and designed such that after a certain period of operation at the latest they each have at their tips a projection that extends in the longitudinal direction of the electrode. Such simple, rod-shaped electrodes can be manufactured comparatively inexpensively.

It has been customary until now in high-pressure mercury vapor discharge lamps to use electrodes which comprise a thin tungsten rod with a thick, solid electrode head or with a coil which is wound around the tungsten rod at its front end. Alternatively, the tungsten rod itself may be helically coiled at the end. DE 381 3421 A1, cited above, shows examples of this. It is ensured by such a relatively thick electrode head that the electrode stability is maintained over a wide current range, i.e. during starting-up and during operation of the lamp, and that cooling through radiation is improved. A typical diameter of such an electrode head in classical UHP lamps is between 800 μm for 100 W UHP-lamps and 2000 μm for 275 W UHP-lamps. The manufacture of such electrodes having solid heads or defined coils obviously involves a significant expense, which increases the total price of the high-pressure mercury vapor discharge lamps.

Further investigations have surprisingly shown, however, that a suitable construction, i.e. the choice of suitable dimensions for such a rod-shaped, essentially cylindrical electrode, can achieve that the electrode will indeed exhibit the desired projection after a given period of operation at the latest. The length of such a projection can reach the size of approximately the diameter of the relevant electrode, the measurements of the rod-shaped electrode being selected such that the projection is so shaped that its length, shape, and position at the electrode tip are essentially stable—i.e. viewed in the long term—apart from customary brief fluctuations. The costs can be substantially reduced when such simple electrodes are used for manufacturing the lamps.

There are various options for the precise design of the electrodes such that they have projections at their tips after the specified period of operation, according to the invention:

First, simple rod-shaped electrodes may be used whose diameter and free electrode length—defined by the distance from the exit of the respective electrode from the seal portion, i.e. the point of contact between the electrode and, for example, quartz glass, to the tip of the relevant electrode—is selected such that the projections are formed spontaneously during operation of the lamp at the latest within the specified, given period of operation. It has surprisingly been found in experiments that, with a suitable selection of the diameter and electrode length under certain temperature conditions, i.e. for certain working currents, simple rod-shaped electrodes have a strong growth of such projections at the electrode tips, and the projections stay sufficiently stable during the entire life span of the lamp. In addition, this growing projection guarantees arc stability and reduces the power input into the electrode per current unit and thus the heat flow in the direction of the seal portions, as compared with the original rod-shaped geometry.

Preferably, rod-shaped electrodes are used whose electrode diameters are $\leqq 600$, preferably $\leqq 500$ μm, and particularly preferably $\leqq 450$ μm. Preferably, the electrode diameters are $\geqq 200$, particularly preferably $\geqq 300$ μm. Moreover, it has been found that a suitable selection of such electrode diameters at the tips of the rod-shaped electrodes directly behind the projection causes a swelling to be formed by the tungsten accumulated there in the course of the operating time. This results in an increase in the rod diameter at the point directly behind the projection, while in addition a wrinkling of the electrode surface thus formed provides an intensified radiation cooling of the electrode.

Preferably, the electrode can be designed such that the growth of the projection at the electrode tip takes place in the first 30 hours of operation of the lamp, the strongest portion of the growth process taking place in the first 10 hours of operation already. At the same time, the growth process is related to the decrease in the operating voltage by more than 5 V in the high-pressure mercury vapor discharge lamp within the first 30 hours of operation.

In order to circumvent this growth process in the first hours—i.e. in order to provide appropriately formed electrodes right at the start—it is also possible to produce the projections by irradiating the tips of the rod-shaped electrodes with a laser during manufacture already, for example before the rod-shaped electrode is inserted. However, the diameter of the rod-shaped electrodes and the free electrode length of these electrodes (including the projections) must then be selected such that the corresponding projections remain sufficiently stable during operation of the high-pressure mercury vapor discharge lamp. For this purpose, the dimensions must be exactly selected as described above. The laser treatment merely ensures that the electrodes have projections of the desired shape from the outset. Such a laser treatment is an additional process step in lamp manufacture, but the cost of this step is not comparable to the expensive manufacture of the electrodes mentioned above having thickened heads or to the manufacture of helical electrodes. This means that a much more economical manufacture is also possible for lamps having such electrodes.

Particularly advantageously, the invention is applicable to high-pressure mercury vapor discharge lamps which have a power rating of between 20 and 60 W, preferably a power rating of approximately 40 or approximately 50 W. These are relatively small lamps, which could also be denoted miniaturized high-pressure mercury vapor discharge lamps.

A further parameter that is preferably to be adjusted is the wall load of the lamp, which should preferably be $\geqq 0.7$ W/mm$^2$, particularly preferably $\geqq 1$ W/mm$^2$. The halogen quantity, for which bromine is preferably used, is advantageously between $10^{-5}$ μmole/mm$^3$ and $2\times10^{-4}$ μmole/mm$^3$.

The high-pressure mercury vapor discharge lamps according to the invention as described above can be used in any projector system. Particularly, in the preferred further designed variant with the seal portions having a smaller cross-sectional area, the lamps can be used particularly advantageously in a projector system for high-pressure mercury vapor discharge lamps with an elliptical reflector, which has a distance of $\leqq 50$ mm, preferably $\leqq 45$ mm between its two focal points. The reflectors used in projector systems until now had a substantially greater focal point distance, which overall leads to a greater space requirement of the optical systems in the projector housing.

However, the lamp can also be used in principle in other applications, for example in the automotive sector, in medical devices, or in other lighting sectors.

These and other aspects of the invention are apparent from and will be elucidated with reference to the embodiments described hereinafter, though the invention should not be considered as limited to these. In this case, like reference numerals refer to like parts.

Figure 2:
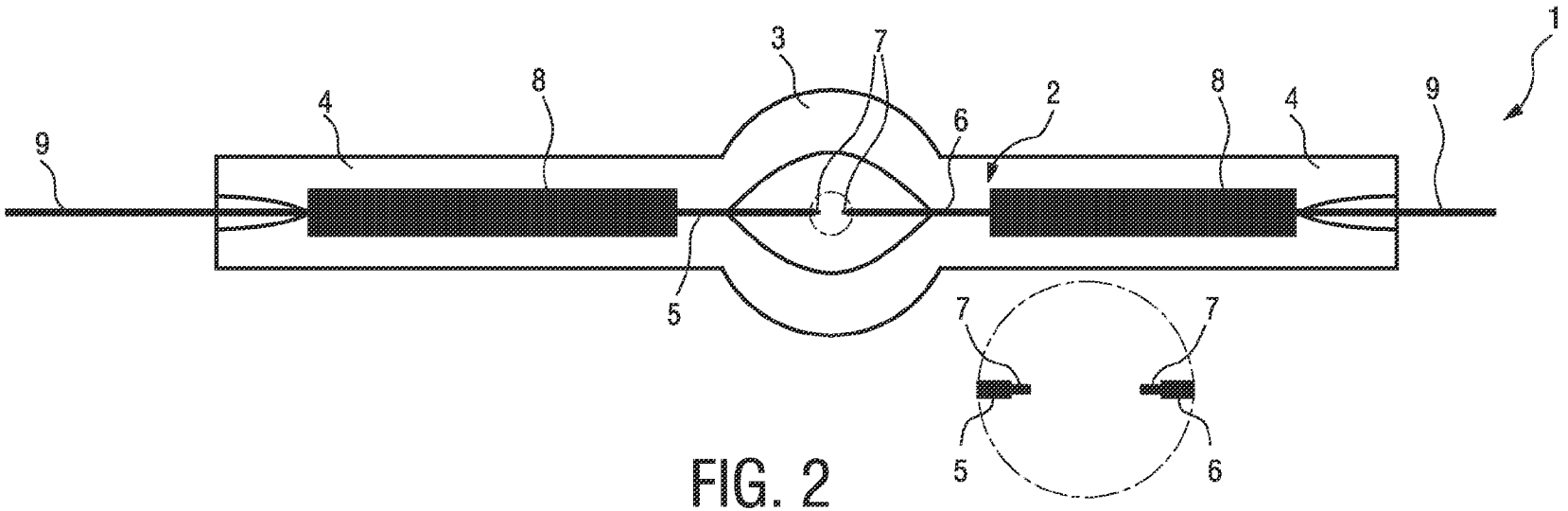
Figure 3:
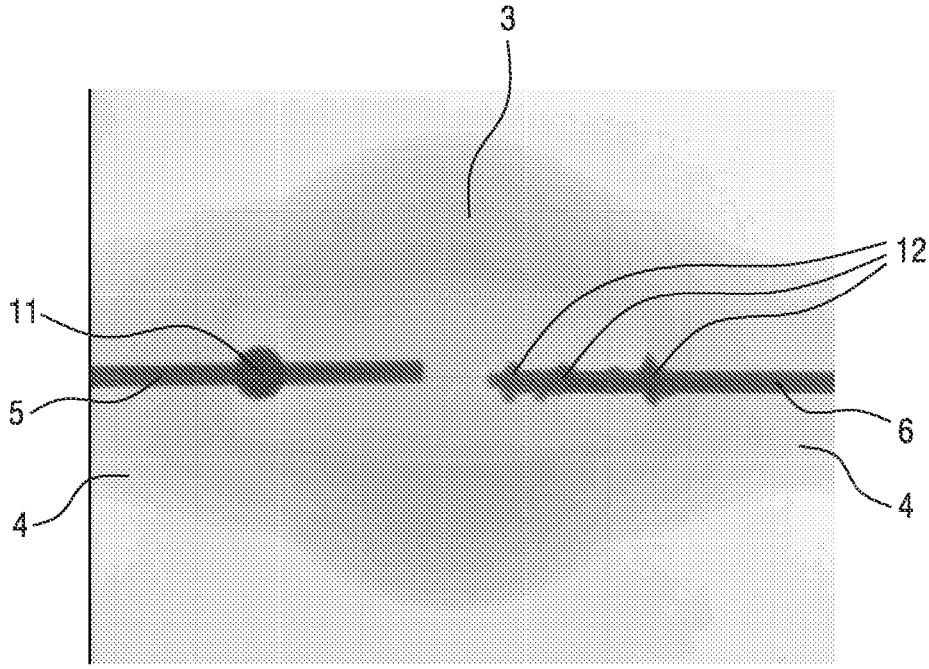
Figure 4:
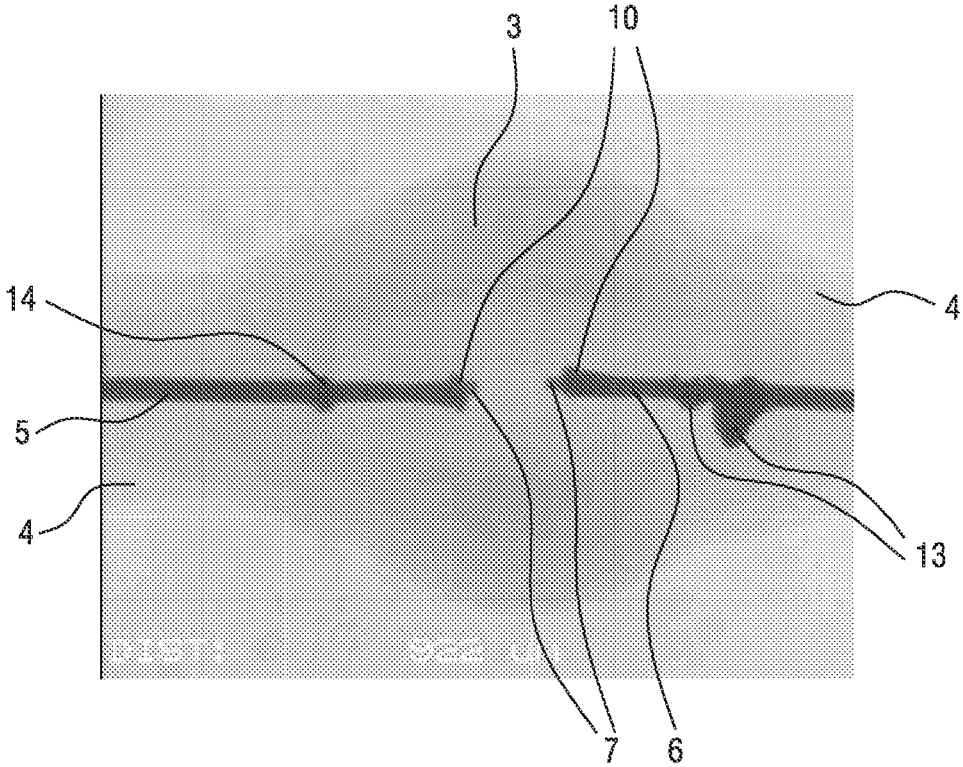
Figure 5:
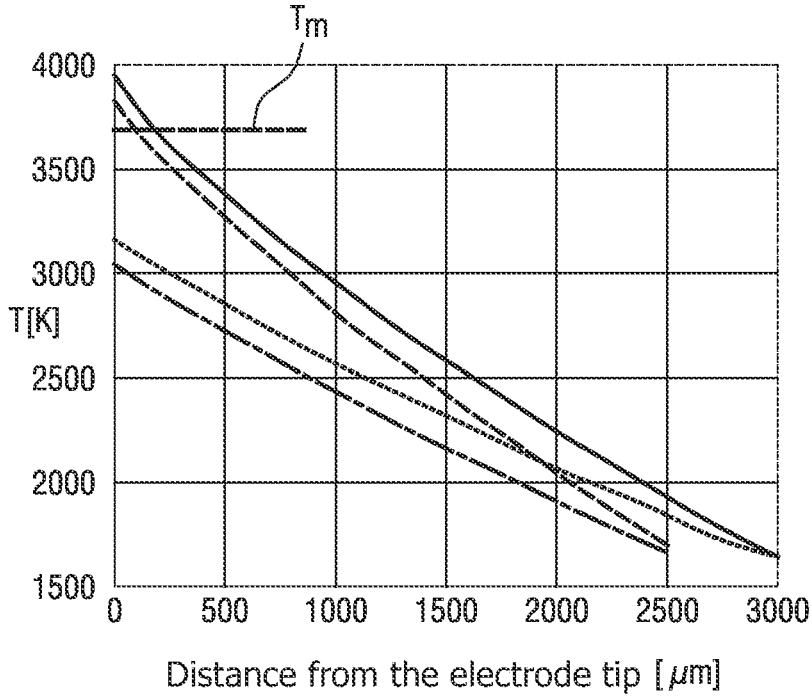
Figure 6:
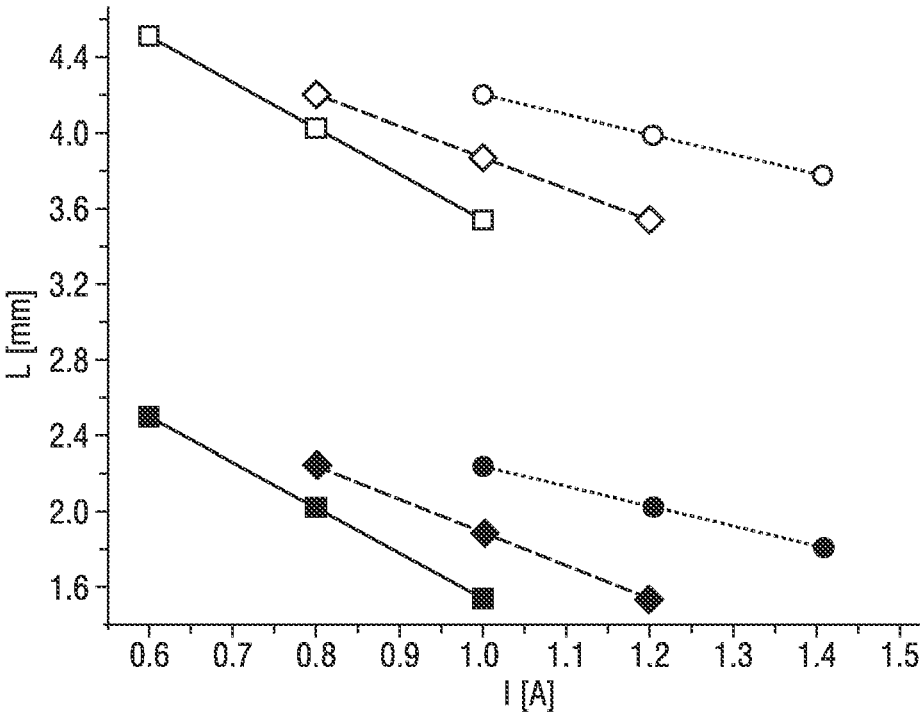
Figure 7:
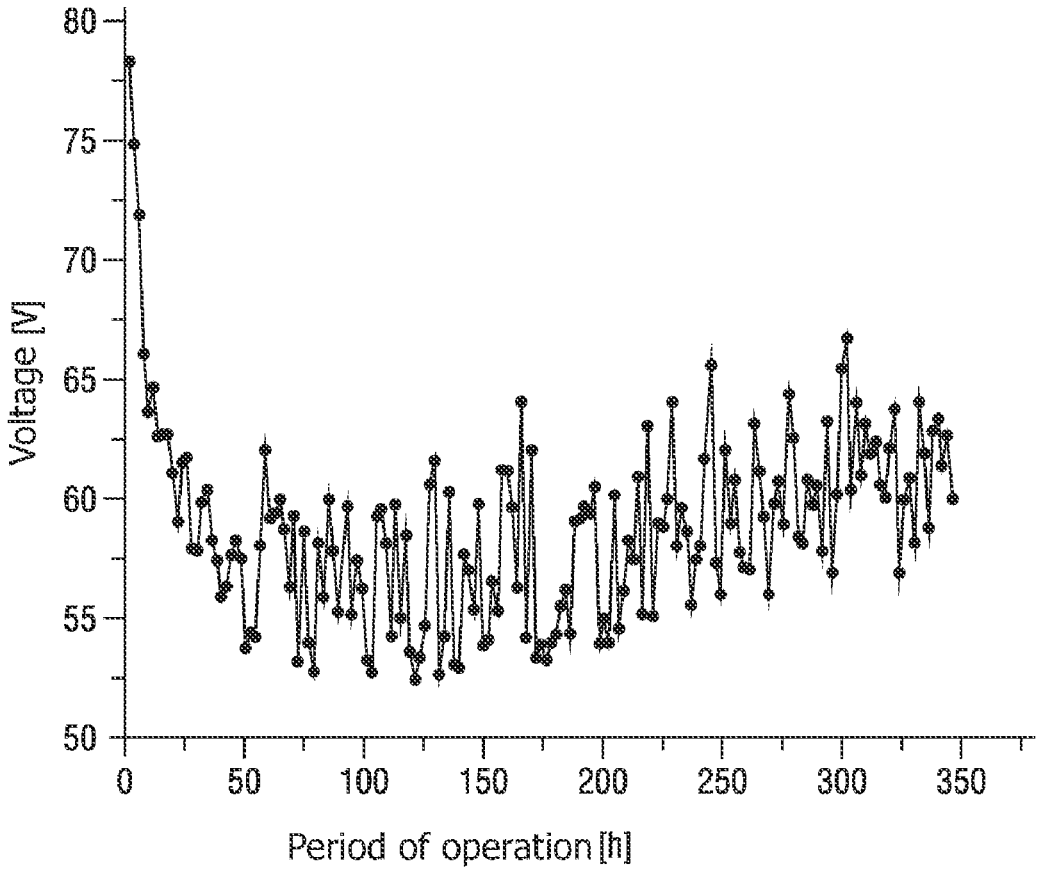
Figure 8:
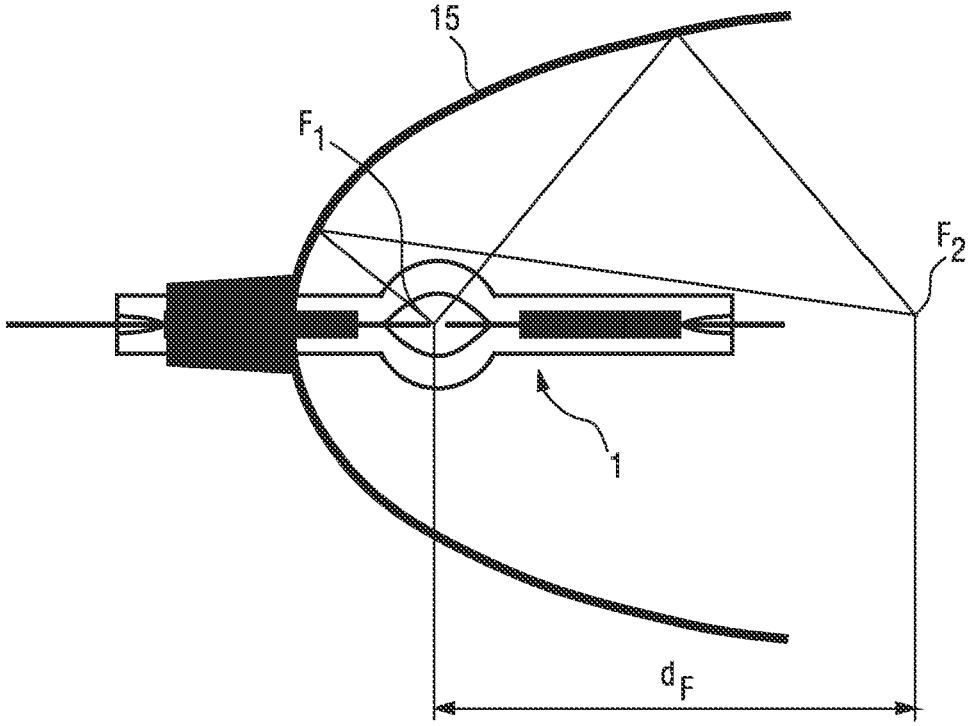
Figure 9:
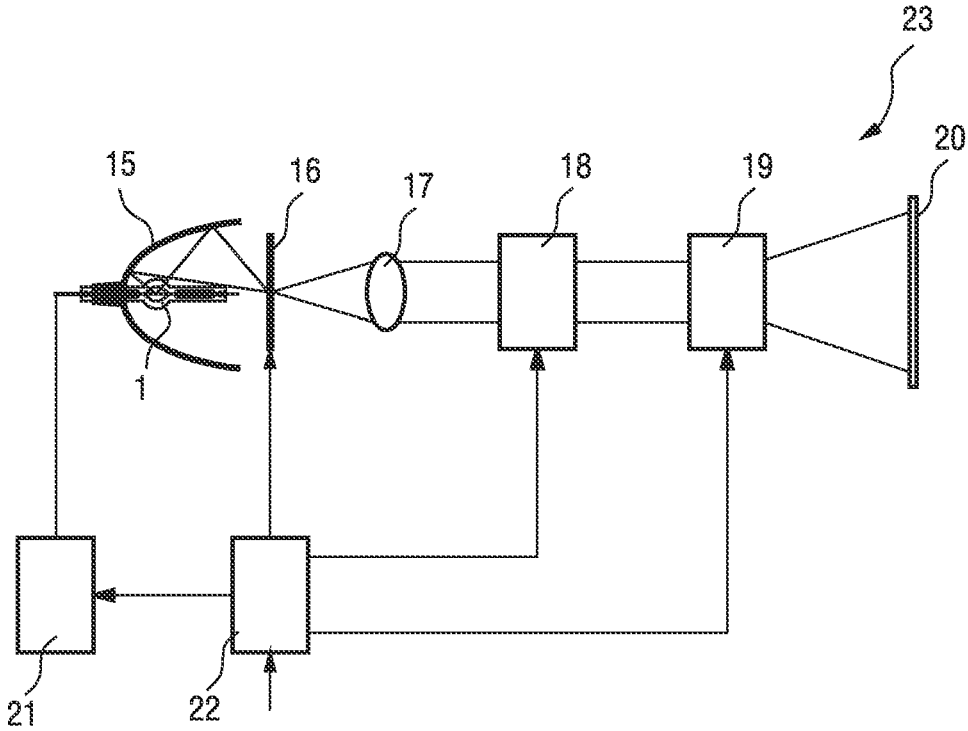

In the drawings:

FIG. 1 shows a longitudinal section through a high-pressure mercury vapor discharge lamp, according to a first embodiment, before the first start-up, FIG. 2 shows a longitudinal section through the high-pressure mercury vapor discharge lamp of FIG. 1, but after the start-up, with an enlarged schematic representation of the electrode tips, FIG. 3 shows a radiograph of an embodiment of a high-pressure mercury vapor discharge lamp according to the invention after a few minutes of operation, FIG. 4 shows a radiograph of an embodiment of a high-pressure mercury vapor discharge lamp according to the invention after an operating period of approximately 200 hours, FIG. 5 plots the dependence of the temperature T of the electrode on the distance from the electrode tip for different free electrode lengths and different electrode diameters, FIG. 6 is a graph showing the advantageous regions for selecting the free electrode length L in dependence on an average operating current I of the lamp for different electrode diameters, FIG. 7 is a graph showing the voltage drop in a high-pressure mercury vapor discharge lamp according to the invention in dependence on the period of operation, FIG. 8 diagrammatically shows an elliptical reflector with a high-pressure mercury vapor discharge lamp according to FIG. 1 installed therein, and FIG. 9 shows a functional arrangement of the reflector with the high-pressure mercury vapor discharge lamp according to FIG. 7 in a schematically represented projector system.

The high-pressure mercury vapor discharge lamp 1 schematically shown in FIGS. 1 and 2 and the high-pressure mercury vapor discharge lamp shown in FIGS. 3 and 4 are preferred embodiments which are each operated with a power of approximately 50 W.

In a customary way, the lamps 1 comprise an envelope 2 of quartz glass with a centrally arranged discharge vessel 3 and two seal portions 4 arranged at opposite sides of the discharge vessel 3. Electrodes 5, 6 extend into the discharge vessel 3 from the seal portions 4. These electrodes 5, 6 are connected in the seal portions 4 to respective molybdenum foil sections 8 which are connected at their other ends to the supply lines 9, usually molybdenum wires. The electrode gap $d_e$, i.e. the distance between the mutually facing tips of the electrodes 5 and 6, is approximately 1.5 mm.

Besides with a rare gas, in the present case argon with a pressure of 200 mbar, the discharge vessel 3 is filled with oxygen, mercury, and a halide, here bromine. The oxygen is present in only a very small quantity. Generally, the oxygen quantity introduced into the lamp by the surface oxidation of the metal parts is sufficient. The bromine quantity is approximately $1\times10^{-4}$ μmole/mm$^3$. The mercury is present in a quantity of greater than or equal to 0.15 mg/mm$^3$ and smaller than or equal to 0.35 mg/mm$^3$. The total mercury quantity is 6 mg in the present preferred embodiment (this corresponds to approximately 0.17 mg/mm$^3$). The wall load in this lamp is more than 0.7 W/mm$^2$.

The lamp envelope is manufactured from a quartz glass tube having an outer diameter of 4.1 mm and an inner diameter of 2 mm. The discharge vessel 3 is shaped in a glass lathe, in which the tube is held at both ends in a headstock and a tailstock. While the tube is being heated in its central region, the headstock and the tailstock are brought together in order to compress the material in the central region, i.e. at the thickest point of the discharge vessel. At the same time, the tube is radially widened at the heated areas by an internal overpressure, for example through injection of an inert gas, in order to achieve the desired shape of the discharge vessel. The exact external shape of the discharge vessel can be determined from the outside by pressure from a negative mold. Such methods are known to those skilled in the art from U.S. Pat. No. 4,389,201, for example. In order to obtain as large as possible a compression of the material in the central region of the discharge vessel 3, the compression and expansion process preferably takes place in at least two stages, i.e. first compression takes place, then stretching, then compression again, and finally stretching again. This process may be carried out for a longer period until the desired shape has been achieved. The finished discharge vessel then has an envelope outer diameter $d_a$ of 7.1 mm and an envelope inner diameter $d_i$ of 3.5 mm in the location of greatest thickness. This means that the wall thickness $d_w$ is approximately 1.7 mm, corresponding to a compression of approximately 300% with respect to the original wall thickness of the glass tube.

Subsequently, for example, the electrode 5 fastened on one side to the molybdenum foil and to the lead wire 9, is provided. Then the discharge vessel 3 is filled with mercury in the form of a mercury droplet. This usually happens in an inert gas atmosphere. Then the second electrode 6 is inserted. Thereafter the glass tube section is sealed off at one side in order to produce the seal portion that is to seal around the discharge vessel 3 at this side. Subsequently, the discharge vessel 3 is filled from the still open side with the desired halogen, for example in the form of methyl bromide as described in DE 38 13 421 A1, and filled with the desired rare gas, and finally the second seal is provided, whereby the discharge vessel 3 is completely sealed. These methods are also known to those skilled in the art from U.S. Pat. No. 4,389,201, for example. The electrodes are preferably positioned with the help of a monitoring system so as to attain the exactly specified electrode gap $d_e$.

The small thickness of the initial glass tube on the one hand ensures that the diameter of the seal portion 4 or the seals is only 3.6 mm, i.e. the cross-sectional area of the seal is approximately 10 mm$^2$. The strong compression process in forming the discharge vessel on the other hand ensures that the wall thickness in the region of the discharge vessel is thick enough for withstanding high mercury vapor pressures of 200 bar and more.

The length of the molybdenum foils in the present case is just below 12 mm, the length of the seal portions is only approximately 15 mm. Thus, with a length of the discharge vessel of approximately 7 mm, it is possible to design a lamp envelope 2 having a total length of only approximately 36 to 38 mm. The selected lamp dimensions, particularly the small diameter $d_s$ of the seal portions 4 and the related smaller cross-sectional area, achieve that the temperatures at the outer ends of the seal portions 4 are below the permissible temperature 400° C. also in the case of the seal portions 4 being shorter than in the known lamps.

This structure renders it even possible to achieve a dramatic temperature reduction at the outer ends of the seal portions in experiments. Thus, for comparison, UHP lamps were made in the customary way from glass tubes with a diameter of approximately 6 mm, and these were compared with the UHP lamps manufactured from 4-mm glass tubes as shown in FIG. 1. The seal portions of the lamps from the 4 mm tubes had half the cross-sectional area of the lamps manufactured from the 6-mm tubes. This reduction in the cross-section led to a temperature lower by 100 K at the ends of the seal portions.

In order to be able to develop the lamp as economically as possible, moreover, simple rod-shaped electrodes were used, but the electrode diameter d and the free electrode length L from the tip of the electrode 5, 6 to the exit point from the quartz glass of the seal portion 4 were selected in dependence on the average operating current I such that in the course of operation, preferably in the first 10 hours of operation, a substantially stable projection 7 is formed at the electrode tip. This is shown in FIG. 2, which additionally shows an enlarged detail of the lamp 1 in the region of the electrode tips (schematically shown). The projections 7 achieve that the electrodes 5, 6 have a sufficiently high temperature above the melting point of mercury at their outermost tip, i.e. in the region of the projection 7, in order to ensure a sufficient electron emission. At the same time, these projections 7 guarantee a stable position for the discharge arc, so that flickering of the arc is avoided.

FIGS. 3 and 4 show radiographs of a further prototype of the lamp according to the invention. FIG. 3 shows the lamp after an operation of a few minutes, and FIG. 4 shows the same lamp after an operation of approximately 200 hours. Here, the electrode gap is approximately 0.9 mm.

The lamp was operated at a rated wattage of 50 W. Such a lamp, according to the invention, can be operated here with customary drivers in so-termed pulsed operation. Descriptions of advantageous current waveforms favorable for a formation of sturdy electrode projections as well as appropriate drivers for operating the lamp can be found, for example, in WO 95/35645, WO 00/36882, and WO 00/36883.

The operation was interrupted for producing the radiographs each time, and the radiograph was generated from the cold lamp.

As the radiograph of the as yet almost unoperated lamp in FIG. 3 shows, the electrodes are initially simple rod-shaped electrodes. This can be recognized particularly well for the left-hand electrode 5. The almost spherical dot 11 is due to mercury, which condenses in the cooled-off condition of the lamp and is usually deposited in drop form at the electrodes 5, 6, to evaporate immediately again after the start-up of the lamp. The right-hand electrode 6 is rod-shaped just as the left-hand electrode 5, but different mercury deposits 12 have the effect that the rod shape cannot be recognized so well here.

By way of comparison, FIG. 4 clearly shows how the desired projections 7 are formed at the tips of the electrodes 5, 6 during operation. At the same time, tungsten deposits directly behind the tip 7 lead to a swelling 10 of the electrodes 5, 6. The diameter increases by approximately 10% in this location. At the same time, the electrode surface in this region becomes wrinkled. The radiation cooling of the electrode 5, 6 is substantially improved by this swelling and wrinkling of the surface.

The remaining apparent swellings 13, 14 at the electrodes 5, 6 are again caused by condensed mercury, which is deposited at the electrodes 5, 6 in the cold condition of the lamp and evaporates again during operation.

In order to achieve the desired growth of the projections 7 at the rod-shaped electrodes 5, 6, one cannot select just any rod-shaped electrodes, but it should be heeded, according to the invention, that the diameter d and the free electrode length L are suitably selected in dependence on the desired average operating current I. If the electrodes 5, 6 are too long, they will become very hot in the transition region during operation and as a rule will break already during the start-up of the lamp. Very short electrodes 5, 6 lead to a strong leaping of the discharge arc and in addition to a recrystallization in the seal portion due to too strong a heat transport into the seal portions 4.

In order to show the dependence of the electrode temperature on the free electrode length L and the electrode diameter d, results of a simulation implemented for finding the suitable dimension are shown in FIG. 5. The electrode temperature T in K along the electrode is plotted as a function of the distance from the electrode tip in μm. The fusing temperature $T_m$ of the electrode material of 3680 K is also shown. The topmost drawn line shows the temperature gradient for an electrode having a diameter d of 300 μm with a free electrode length L of 3,000 μm. The dashed curve below it shows the temperature gradient for the same electrode, but with a free electrode length L of only 2,500 μm. The third, dotted curve shows the temperature gradient for an electrode having a diameter d of 400 μm with a free electrode length L of 3,000 μm, and the lowermost, dot-and-dash curve shows the temperature gradient for a corresponding electrode having a diameter of 400 μm and a free electrode length of 2,500 μm. For this simulation the average operating current I was taken to be 0.8 A each time. The power input into the electrode here is approximately 8 W/A. These simulations show clearly that both the electrode diameter d and the free electrode length L affect the temperature gradient along the electrode. It is understood that the operating current I also has an influence on the temperature gradients, wherein the stronger the average operating current I, the higher the temperature. This, however, is not shown in FIG. 5 for greater clarity.

It has been found that, in order to achieve the desired growth of the projections 7 at the electrode tips in an ideal shape, the diameter of the rod-shaped electrodes (5, 6) should be between 220 μm and 420 μm, and the free electrode length L should be selected within certain fixed boundaries in dependence on the operating current and in dependence on the electrode diameter d. Here, the upper limit value, i.e. the maximum free electrode length $L_{max}$, and the lower limit value, i.e. the minimum free electrode length $L_{min}$, can be calculated as follows:

$$L_{min}=6.4-8\cdot d+(15\cdot d-7)\cdot I \quad (1)$$

and the maximum electrode length:

$$L_{max}=8.4-8\cdot d+(15\cdot d-7)\cdot I \quad (2)$$

in dependence on the diameter d of the electrode and the desired average operating current I of the high-pressure mercury vapor discharge lamp (1). In the equations (1) and (2), the current I is expressed in the unit A and the electrode diameter d, the minimum free electrode length $L_{min}$, and the maximum free electrode length $L_{max}$ are all expressed in the unit mm. The average operating current I relates to the RMS value (Root Mean Square Value), not the maximum value, which can be substantially higher in the case of pulsed operation.

FIG. 6 once again shows the upper and lower limit values $L_{max}$, $L_{min}$ calculated for the free electrode length L in dependence on the current I for different electrode diameters. The free electrode length L is plotted in mm here as a function of the current I in A. The drawn curves show the upper and lower limits for the free electrode length L with an electrode diameter d of 300 μm, the dashed curves show the limit values for an electrode diameter d of 350 μm, and the dotted curves show the values for an electrode diameter d of 400 μm. This graph also shows that for certain working currents I a certain electrode diameter d should be preferably selected, so that a particularly good growth process is ensured. Thus, an electrode diameter d of 300 μm can be selected in a current range of approximately 0.6 A to approximately 1 A, an electrode diameter d of 350 μm preferably in the current range of approximately 0.8 A to approximately 1.2 A, and an electrode diameter d of 400 μm in the range of approximately 1 A to approximately 1.4 A.

The values or ranges indicated in the following Table represent the ideal values determined in the experiments for which an optimum growth of the desired projections at the electrode tips can be achieved:

| Electrode diameter d, [μm] | L [mm], I = 0.6 A | L [mm], I = 0.8 A | L [mm], I = 1.0 A | L [mm], I = 1.2 A | L [mm], I = 1.4 A |
|---|---|---|---|---|---|
| 275 < d < 325 | 2.5-4.5 | 2.0-4.0 | 1.5-2.5 | — | — |
| 325 < d < 375 | — | 2.2-4.2 | 1.9-3.9 | 1.5-3.5 | — |
| 375 < d < 425 | — | — | 2.2-4.2 | 2.0-4.0 | 1.8-3.8 |

A number of configurations are indicated by way of example below, resulting, for example, from the equations (1) and (2), or FIG. 6, or from the above Table:

1) A first high-pressure mercury vapor discharge lamp having a spherical discharge vessel is operated at 50 W and has an electrode gap of 1.3 mm. The operating voltage is 62.5 V and the average operating current is 0.8 A. Rod electrodes having a diameter of preferably 0.3 mm and a free electrode length of 2.5 mm should then be selected.
2) A second high-pressure mercury vapor discharge lamp having a spherical discharge vessel is operated at 50 W and has an electrode gap of 1 mm. The operating voltage is 50 V and the average operating current is 1 A. Rod electrodes having a diameter of preferably 0.35 mm and a free electrode length of 2.8 mm should then be selected.

3) A third high-pressure mercury vapor discharge lamp having an elliptical discharge vessel is operated at 40 W and has an electrode gap of 1.5 mm. The operating voltage is 67 V and the average operating current is 0.6 A. Rod electrodes having a diameter of preferably 0.3 mm and a free electrode length of 3.1 mm should then be selected.

4) A fourth high-pressure mercury vapor discharge lamp having an elliptical discharge vessel is operated at 40 W and has an electrode gap of 1.35 mm. The operating voltage is 60 V and the average operating current is 0.66 A. Rod electrodes having a diameter of preferably 0.28 mm and a free electrode length of 2.9 mm should then be selected.

The exact growing process of the projection at the electrode tips can be followed at best via a measurement of the operating voltage in dependence on the operating time. Given the same pressure and the same power, the voltage is determined by the electrode gap, and the growth of the desired projections at the electrode tips leads to a reduction of the electrode gap, so at the same time a voltage drop will also indicate the growth process. This is represented in FIG. 7, where the operating voltage in V is plotted against the time of operation in hours. The lamp was operated here—in order to simulate as realistic an operation as possible—for two hours and then cooled down for 15 minutes each time. The electrode gap at the beginning of the experiment was 1.25 mm, i.e. still without projections at the rod-shaped electrodes. As is to be seen from this Figure, the voltage drops in the first 10 hours of operation by more than 10 V already and then sinks further during the first 30 hours of operation. This shows that the desired projections are formed already in the first hours of operation of the lamp. The Figure also shows that—apart from the usual fluctuations—the projections remain very stable when viewed on a long-term scale, i.e. the electrode gap does not change as significantly during further lamp life as in the first 30 hours of operation.

The calculations and tests carried out clearly show that it is surprisingly possible to manufacture a UHP lamp having excellent operating properties with a simple rod electrode that is extremely economical to manufacture. It suffices to ensure that the suitable dimensions of the electrode are selected in dependence on the envisaged operating current. Besides, the lamps manufactured by the methods described above have the advantage that they are very short. This renders it possible to assemble the lamps together with an elliptical reflector which has a significantly shorter focal point distance than has been the case with projector systems until now.

This is schematically represented in FIG. 6. FIG. 6 only shows the schematic arrangement of the lamp 1 in the reflector 15 without the devices for contacting the supply line of the lamp 1. As is apparent from the Figure, the reflector 15 has a first focal point $F_1$. This focal point $F_1$ is in the center of the discharge vessel of the lamp 1. In addition, the reflector 15 has a second focal point $F_2$ far lying in front, which is outside the reflector 15. The focal point distance $d_F$ is 45 mm here, and hence is far below the customary focal point distance in reflectors conventionally used in projection systems. This small focal point distance $d_F$ has the advantage that the entire optical arrangement of the projection system can be made shorter.

Such a projection system 23 is shown schematically in FIG. 9. Starting from the lamp 1, the light is reflected in the reflector 15 onto the second focal point $F_2$. This focal point $F_2$ is, for example, directly present in a customary color-changing device, for example on a color changer disk 16, which ensures that temporarily different colors are sequentially generated. From the color changer disk 16, the light is transmitted by a converging lens 17 onto a display device 18. Such a display device 18 may be, for example, a DLP® system (DLP=Digital Light Processing) from the Texas Instruments® company. Such a display device 18 comprises a kind of chip on which a plurality of tiny mobile mirrors are affixed as individual display elements, one mirror for each pixel to be represented. These mirrors are illuminated by the light. Depending on whether a pixel on the projection surface, i.e. in the image to be represented, should appear bright or dark, the associated mirror is tilted such that the light is reflected onto the projection surface or away from it towards an absorber. Alternatively, any other system may be used, for example an LCD (Liquid Crystal Display) system, with which a defined reduction of the light is possible. A wide variety of display devices 18 as well as their operation in the projection systems 23 are known to those skilled in the art, as are different color-changing devices.

The image is then further projected onto a projection surface 20 by means of an objective lens 19. The lamp 1 is operated by a customary lamp control unit 21. In addition, the entire projection system 23 is controlled by a system control unit 22 which drives the lamp control unit 21, the color changer 16, the display device 18, and if necessary also the objective lens 19, and particularly arranges for the synchronization of the operation of the lamp 1, the color changer 16, and the display device 18.

Due to the outstanding characteristics of the lamp according to the invention, particularly the low temperature at the ends of the seal portions, it is even possible to use reflectors which are enclosed by a safety screen in front, without this leading to an overheating of the lamp inside the reflector. Such a safety screen has the advantage that no pieces of broken glass can reach other regions of the projector system in cases in which it comes to a destruction of the lamp after a longer period of operation, but the lamp 1 together with the reflector 15 can be easily replaced by the final user.

Finally, it is pointed out once again that the lamps actually represented in the Figures and the description and the methods are merely examples of embodiments, which can be varied to a large extent by those skilled in the art without departing from the scope of the invention. In addition, it is pointed out for the sake of completeness that the use of the indefinite articles "a" or "an" does not exclude that the relevant characteristics may also be present in plurality.

The invention claimed is:

1. A method of manufacturing a high-pressure mercury vapor discharge lamp, comprising the following process steps:

manufacturing an envelope from a tube of high temperature resistant material, said envelope having a discharge vessel and two tube sections remaining at opposite sides of the discharge vessel, inserting electrodes into said two tube sections, which electrodes are each connected via a respective metal strip section to a supply line, such that the electrodes extend into the discharge vessel and the electrode gap is smaller than or equal to 2.5 mm, providing the discharge vessel with a filling which essentially comprises substances selected from the group consisting of: rare gas, oxygen, halogen consisting of chlorine, bromine, iodine, or a mixture thereof, as well as mercury in a quantity greater than or equal to 0.15 $mg/mm^3$, sealing the discharge vessel by compressing or fusing the tube sections into seal portions, into which the metal strip sections are tightly embedded, wherein the discharge vessel is formed such and the tube sections at the discharge vessel are pressed or fused into the seal portions such that the seal portions have a cross-sectional surface area of between 6 $mm^2$ and 20 $mm^2$ and the tube is compressed in axial direction by more than 250% in the location of greatest thickness of the discharge vessel causing a simultaneous radial expansion.

2. A method as claimed in 1, wherein the lamp envelope is formed from a tube having an outer diameter of approximately 4.1 mm and an inner diameter of approximately 2 mm.

3. A method as claimed in claim 1, wherein the discharge vessel is formed such and the tube sections at the discharge vessel are fused into the seal portions such that the diameter of each seal portion is between 2.5 mm and 5 mm.

4. A method as claimed in claim 1, wherein the halogen quantity is between $10^{-5}$ μmole/$mm^3$ and $2 \times 10^{-4}$ μmole/$mm^3$.

* * * * *